United States Patent [19]

Haglund

[11] Patent Number: 4,910,836

[45] Date of Patent: Mar. 27, 1990

[54] SEAT BELT BUCKLE

[75] Inventor: Artur L. Haglund, Vargarda, Sweden

[73] Assignee: General Engineering (Netherlands) B.V., Utrecht, Netherlands

[21] Appl. No.: 258,698

[22] PCT Filed: Feb. 10, 1988

[86] PCT No.: PCT/SE88/00045

§ 371 Date: Oct. 11, 1988

§ 102(e) Date: Oct. 11, 1988

[87] PCT Pub. No.: WO88/06013

PCT Pub. Date: Aug. 25, 1988

[30] Foreign Application Priority Data

Feb. 10, 1987 [GB] United Kingdom ..... 8702916

[51] Int. Cl.[4] ..... A44B 11/25

[52] U.S. Cl. ..... 24/636; 24/637; 297/468; 280/805

[58] Field of Search ..... 24/636, 637, 633, 634, 24/643, 648, 641, 635, 646, 638, 163, 172; 297/468, 483; 280/801, 805

[56] References Cited

U.S. PATENT DOCUMENTS 3,561,690 2/1971 Muskat ..... 280/805 X 3,952,967 4/1976 Barile et al. ..... 280/805 X

FOREIGN PATENT DOCUMENTS 98726 1/1984 European Pat. Off. ..... 24/633

*Primary Examiner*—Laurie K. Cranmer

*Attorney, Agent, or Firm*—Spencer & Frank

[57] ABSTRACT

A seat belt buckle has a latching member (7), which engages the tongue of the buckle. The latching member is pivotally mounted on a channel member, engaging lugs (18) formed in apertures in the side walls of the channel in a substantially friction-free manner. The lugs are deformable so that, in an accident situation, the lugs deform and the periphery (17) of the latching member (7) engages the periphery of each aperture in each side wall of the channel. Thus the latching member has a substantially friction-free movement, buth the latching member is able to withstand severe forces.

7 Claims, 2 Drawing Sheets

Figure 4:
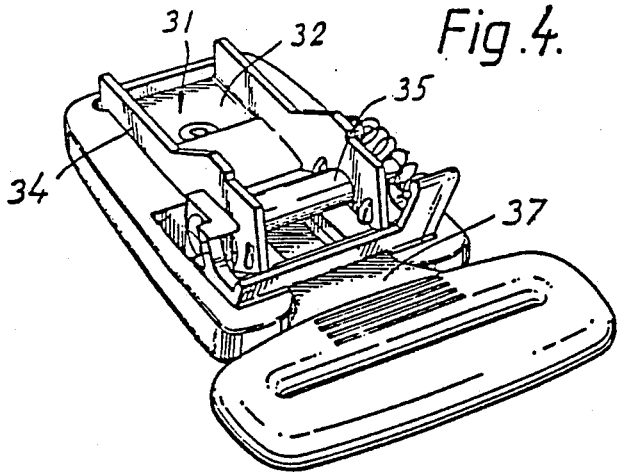

Fig.1.
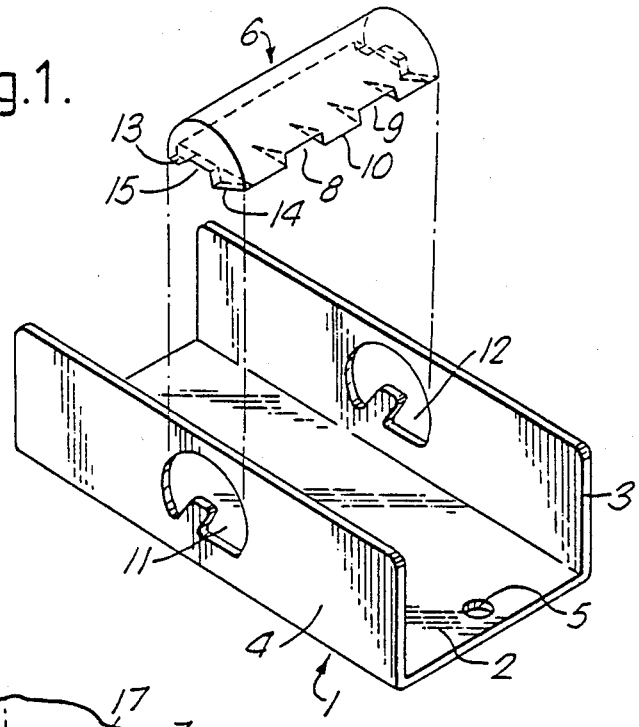
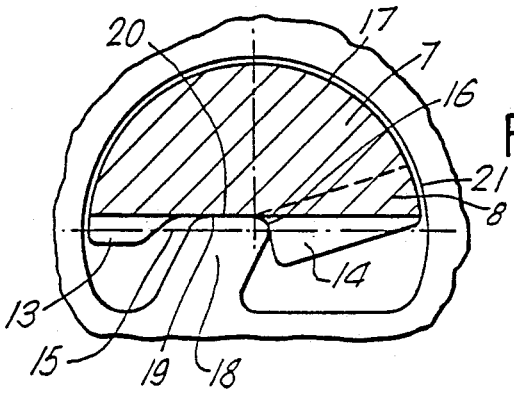
Fig.2.
Fig.3.
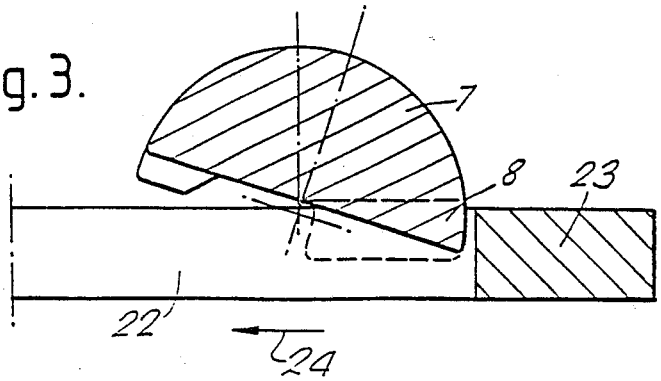

SEAT BELT BUCKLE

The present invention relates to a seat belt buckle and more particularly relates to a seat belt buckle of the type which incorporates a latching member adapted to engage part of a tongue inserted into the buckle, the latching member being rotatable about an axis between a position in which the latching member engages the tongue to retain the tongue in the buckle, and a release position in which the latching member does not engage the tongue, thus permitting the tongue to be removed from or re-inserted into the buckle.

Many buckles of this type have been proposed previously, and it is relatively commonplace for the main part of the buckle to incorporate a channel shaped member, the latching member being pivotally mounted on opposed side walls defined by the channel shaped member. The tongue may be inserted into the buckle along a predetermined path which is usually located adjacent the base of the channel shaped member. The latching member can then rotate so that part of the latching member engages an aperture formed in a tongue, or engages part of a substantially "T" shaped head of the tongue, thus retaining the tongue within the buckle.

It will be appreciated that, when accident occurs, a very severe force may be imparted to the tongue, tending to withdraw the tongue from the buckle, and the buckle must be able to withstand this force if the buckle is to be satisfactory. It is to be appreciated that since the latching member is pivotally mounted at the side wall of the buckle, it is desirable to have the maximum area of contact between the latching member and the side wall of the buckle so that the severe force imparted to the latching member can be satisfactorily transferred to the side wall of the buckle, so that the force can be withsood adequately without the components of the buckle bending or deforming.

One way of mounting the latching member is to provide the latching member with a relatively large diameter trunnions at each end, these trunnions being received in relatively large diameter apertures formed in the side walls of the channel. Thus, in the event of an accident, the large diameter trunnions will engage the large diameter apertures, and the buckle is thus able to withstand the applied forces. However, one disadvantage of such an arrangement is that the large diameter trunnions, within the large diameter apertures cannot be considered to be low friction bearings, particularly if there is metal-to-metal contact over the entire periphery of the trunnions. This is undesirable since the latching member should be able to pivot relatively freely with a minimum of friction.

The present invention seeks to provide a buckle of the type described in which the latching member is able to withstand a relatively large applied force, but is pivoted for relatively friction-free movement.

According to this invention there is provided a buckle for use with a seat belt, said buckle incorporating a rotatably mounted latching member, the latching member being rotatable between a position in which part of the latching member engages a tongue to retain the tongue in position in the buckle, and a position in which the latching member does not engage the tongue, thus permitting the tongue to be introduced into or removed from the buckle, the latching member being pivotally mounted at, or adjacent, each end thereof on a deformable member which can deform under a severe force applied to the latching member, there being substantially point contact between the deformable member and the latching member to provide a substantially friction free bearing, a portion of the latching member adjacent each end thereof being located within an aperture formed in a force-withstanding member, part of the aperture having a configuration corresponding to the configuration of the part of the latching member inserted therein such that, if a severe force is applied to a tongue within the buckle when the latching member is in the latching condition the deformable members deform and the end parts of the latching member are brought into contact with correspondingly shaped portionns of said apertures.

Preferably the apertures are formed in the side walls of a force withstanding member in the form of a channel member.

Conveniently said deformable members comprise projections extending into the said apertures formed in the side walls of the channel member.

Advantageously said projections are formed integrally with the side walls of the channel member.

Conveniently said projections are inclined angularly to the plane defined by the tongue when in the buckle.

Preferably each said aperture has a part circular periphery, and the portions of the latching member received within the apertures also have a part circular periphery, the radius of said part circular peripheries being substantially equal, with the radius of the latching member being the lesser of the two.

Figure 5:
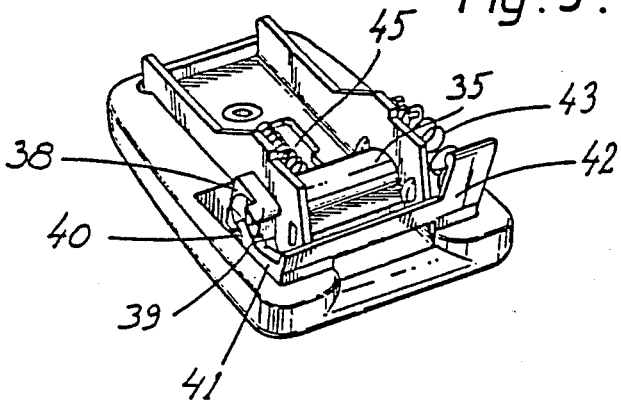
Figure 6:
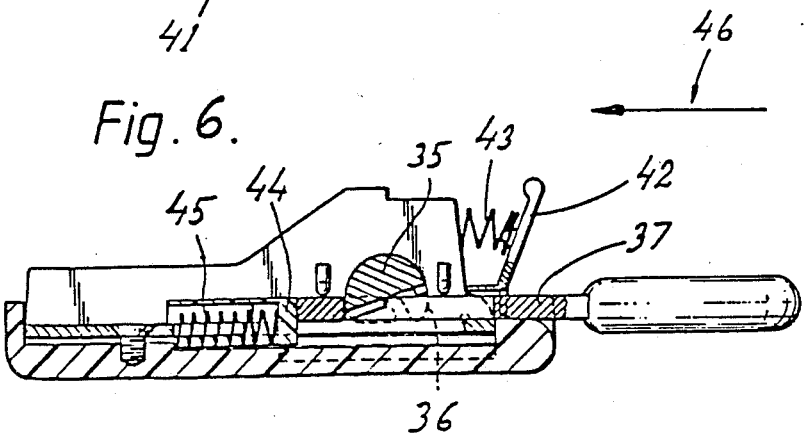

In order that the invention may be more readily understood, and so that further features thereof may be appreciated, the invention will now be described, by way of example, with reference to the accompanying drawings in which:

FIG. 1 is an exploded diagrammatic perspective view showing a channel forming part of a buckle in accordance with the invention, and the latching member adapted for use with the buckle, FIG. 2 is a side view of the side wall of the buckle, with the latching member in position, the view being taken from the inside of the channel, thus showing part of the latching member in cross section, FIG. 3 is a further cross sectional view, taken from a different position to FIG. 2, but showing the latching member in the latching condition, FIG. 4 is a perspective view of part of a real buckle incorporating the invention with the tongue inserted, FIG. 5 is a view corresponding to FIG. 4 with the tongue ejected, and FIG. 6 is a cross section of FIG. 4.

Referring initially to FIG. 1 of the accompanying drawings one example of the buckle in accordance with the invention incorporates a channel shaped member 1 having a substantially flat base 2 and two upstanding side walls 3, 4. The base 2 is provided with an aperture 5 by means of which the channel shaped member may be connected to a strap or the like to enable the buckle to be mounted on a motor vehicle.

The buckle incorporates a latching member 6. The latching member is of substantially semi-circular cross section, and this cross section is shown in hatched lines 7 in FIGS. 2 and 3.

One side edge of the latching member is provided with two angular recesses 8, 9, which are symmetrically arranged, and the cross sectional shape of the recesses 8, 9 is illustrated by means of a dotted line in FIGS. 2 and 3. The recesses define between them an abutment portion 10.

The latching member 6 is dimensioned so that the ends thereof are adapted to be received in apertures 11, 12 formed in the side walls 3, 4 of the channels.

It can be seen that the end portions of the latching member can be considered to be of semi-circular form provided with two additional lugs 13, 14. The lugs define between them a recess 15, and it can be seen that the corner of the recess 15 defined by the lug 14, that is to say the corner 16, is located substantially at the centre of curvature of the arcuate portion 17 of the semi circular periphery of the latching member.

As can be understood, whilst one end of the latching member has been described, the other end has a precisely corresponding configuration.

The apertures 11, 12 are of substantially circular cross section, save that the bottom part of the circle is truncated. Thus the lower part of the aperture is defined by a line parallel with the base of the channel. An angularly inclined finger 18, inclined at an angle relative to the base of the channel, is provided which extends into the corner 16 of the recess 15 defined by the lug 14 on the latching member. It will be appreciated that the finger 18 has a flat upper surface 19 which, when the latching member is in the release position, as illustrated in FIG. 2, abuts a flat surface 19 defining part of the recess 15. The finger 18 is formed integrally with the side wall of the channel.

It will be appreciated that the latching member may be moved pivotally on the finger 18, with substantially only point contact since part of the finger 18 engages the corner 16 which is substantially at the centre of curvature of the arcuate surface 17. Thus the latching member moves in a substantially friction-free manner. The arrangement is such that as the latching member is moved the arcuate surface 17 remains equispaced from the arcuate portion 21 of the periphery of the aperture 11. The arcuate surfaces have substantially equal radii of curvature with the radius of the latching member being slightly less than the radius of the aperture.

The latching member may be moved from the position illustrated in FIG. 2, that is to say the release position, to the position illustrated in FIG. 3 in which it can be seen that the abutment portion 10 is lowered into an aperture 22 formed in a tongue 23 which is inserted into the channel member 1 adjacent the base 2. The tongue is thus restrained and cannot be withdrawn from the buckle in the direction of the arrow 24. The latching member may be moved back to the release position shown in FIG. 2 and the abutment 10 is then disengaged from the tongue 23, enabling the tongue to be removed from the buckle.

The mechanism utilised to effect this rotation of the latching member is not described in detail, since there are many conventional mechanisms for effecting such a rotation, and the precise mechanism utilised to effect the rotation is not relevant to the present invention.

It is sufficient to understand that the latching member is mounted, at either end, on a finger 18 forming part of an aperture in the side wall of a channel. The finger 18 is inclined to the plane defined by the tongue when inserted in the buckle. The upper portion of the aperture is of part-circular configuration, and the portion of the latching member inserted in the aperture has a part circular outer periphery, the outer configuration of the latching member at least partly corresponding with the outer configuration of the aperture. The radius of the part-circular portion of the latching member is slightly less than the radius of the part-circular portion of the aperture to ensure that the latching member can rotate within the aperture.

If the latching is in the latching condition and a severe force is imparted to the tongue 23 tending to withdraw the tongue from the buckle in the direction illustrated by the arrow 24, in other words if an accident situation should arise, a severe force will be imparted, by the tongue, to the latching member 6. The latching member will thus tend to move in the direction of the arrow 24. If this should occur, the finger 18 will deform and the latching member will move slightly in the direction of the arrow 24. However, when the latching member has moved slightly in the direction of the arrow 24 the part circular periphery 17 thereof engages the part circular portion 21 of the edge of the aperture 11, and thus there is a significant area of metal to metal contact to transfer the force applied to the latching member to the channel member 1.

It will thus be appreciated that an embodiment of the invention combines the advantages of a substantially friction free bearing for the latching member, with the advantages of a large metal-to-metal contact to withstand any severe force applied to the latching member should an accident arise.

Referring now to FIGS. 4 to 6 an actual example of a buckle in accordance with the invention is illustrated. The buckle incorporates a channel 31 having a flat base 32 and opposed upstanding side walls 33,34. A latching member 35 is provide which extends across the channel, the ends of the latching member 35 passing through apertures 36 formed in the side walls 33,34 of the channel 31.

The buckle is adapted to receive a tongue 37 which is inserted into the buckle along a path spaced immediately above the base 32 of the channel 31, but beneath the latching member 35. When the tongue 37 has been inserted into the buckle, as shown in FIG. 6, the latching member 35 adopts a condition equivalent to that illustrated in FIG. 3, thus retaining the tongue within the buckle.

One end of the latching member 35 is associated with a drive component 38 provided with projections 39,40 thereon which engage a projection 41 formed on a pivotally mounted actuating button 42 which is biassed to a forward position by a spring 43. The buckle also contains an ejector 44 which is biassed, by means of a spring 45, to a forward-most position.

When the tongue is in the buckle as illustrated in FIG. 6, if the actuating button 42 is pressed, the projection 41 engages the projection 40, causing the latching member 35 to rotate to a release position, such as illustrated in FIG. 2. The tongue 37 is then ejected from the buckle by the spring biased ejector 44. The buckle is then in the condition illustrated in FIG. 5.

Whilst the invention has been described with reference to one embodiment it is to be appreciated that many modifications may be effected without departing from the invention.

I claim:

1. A buckle for use with a seat belt, said buckle incorporating a rotatably mounted latching member, the latching member being rotatable between a latched position in which part of the latching member engages a tongue to retain the tongue in position in the buckle, and a released position in which the latching member does not engage the tongue, thus permitting the tongue to be introduced into or removed from the buckle, the latching member being pivotally mounted in the region of each end thereof on a deformable member which can deform under a severe force applied to the latching member, there being substantially point contact between the deformable member and the latching member when the latching member is in the latched position, to provide a substantially friction free bearing, a portion of the latching member adjacent each end thereof being located within a respective aperture formed in a force-withstanding member, part of each respective aperture having a configuration corresponding to the configuration of the part of the latching member inserted therein such that, if a severe force is applied to the tongue within the buckle when the latching member is in the latching condition the deformable members deform and the ends of the latching member are brought into contact with correspondingly shaped portion of said apertures.

2. A buckle according to claim 1 wherein the force withstanding member is in the form of a channel member having side walls, and said apertures are formed in said side walls.

3. A buckle according to claim 2 wherein said deformable members comprise projections extending into the said apertures formed in the side walls of the channel member.

4. A buckle according to claim 3 wherein said projections are formed integrally with the side walls of the channel member.

5. A buckle according to claim 3 wherein said tongue, when in the buckle lies in a plane, and said projections being inclined angularly to said plane.

6. A buckle according to claim 1 wherein each said aperture has a part circular periphery, and the portions of the latching member received within the apertures also have a part circular periphery, the radii of said part circular peripheries being slightly different, with the radius of the latching member being the lesser of the two.

7. A buckle according to claim 6 wherein the latching member, at each end, has a cross section in the form of a semi circle with at least one projection extending from the diameter of the semi circle, the projection serving to define a corner which is adapted to engage said deformable member.

* * * * *